United States Patent [19]

Clayton

[11] 4,420,024

[45] * Dec. 13, 1983

[54] GOLF CLUB BAG

[76] Inventor: Charles R. Clayton, 606 Coolidge St., Midvale, Utah 84047

[ * ] Notice: The portion of the term of this patent subsequent to Jun. 15, 1999 has been disclaimed.

[21] Appl. No.: 308,913

[22] Filed: Oct. 5, 1981

Related U.S. Application Data

[63] Continuation-in-part of Ser. No. 194,618, Oct. 6, 1980, Pat. No. 4,334,564.

[51] Int. Cl.[3] ..... A63B 55/02

[52] U.S. Cl. ..... 206/315.4; 206/315.3; 206/315.6; 383/4; 190/107

[58] Field of Search ..... 150/1.5 R, 1.5 B, 1.5 C

[56] References Cited

U.S. PATENT DOCUMENTS

| | | | |
|---|---|---|---|
| 1,570,510 | 1/1926 | McQuirk | 150/1.5 R |
| 2,010,166 | 8/1935 | Thompson | 150/1.5 R |
| 2,599,635 | 6/1952 | Hotze | 150/1.5 R |
| 2,704,563 | 3/1955 | Henrich | 150/1.5 R |
| 3,674,072 | 7/1972 | Shuto | 150/1.5 R |
| 3,779,297 | 12/1973 | Stammer | 150/1.5 R |
| 3,901,299 | 8/1975 | Picco | 150/1.5 R |
| 4,334,564 | 6/1982 | Clayton | 150/1.5 C |

*Primary Examiner*—William Price
*Assistant Examiner*—Sue A. Weaver
*Attorney, Agent, or Firm*—Thorpe, North & Western

[57] ABSTRACT

A golf club bag is formed of a plurality of elongate receptacles attached together in a row and parallel to one another to lie generally flat on a support surface. Each receptacle is dimensioned to receive the handle of a golf club. The receptacles are made of a resilient material which will allow folding the receptacles over one another into a bundle as well as laying the receptacles out generally flat. Fastening elements are installed on the endmost receptacles to join them together to secure the receptacles in the folded arrangement. A handle is attached to the receptacles centrally thereof for holding the bag. If desired, another row of receptacles can be formed and attached back-to-back to the first receptacles thereby increasing the number of golf clubs which can be carried. Also included is a cover for placing over the bag when in the folded configuration.

9 Claims, 5 Drawing Figures

GOLF CLUB BAG

BACKGROUND OF THE INVENTION

This is a continuation-in-part of application Ser. No. 194,618, filed Oct. 6, 1980, now U.S. Pat. No. 4,334,564.

This invention relates to an improved flexible, foldable golf club bag.

Conventional golf club bags are typically formed into fairly rigid receptacles having circular or oblong cross-sections into which all of the golf clubs to be carried are placed. In some configurations, plastic cylindrical tubes are positioned in the bag, each of which is for receiving a different one of the golf clubs.

With the above designs, the size and shape of the bag is fairly rigidly fixed so that a predetermined volume of space is required to store or transport the bag. This limits storage flexibility when traveling or moving about and can cause inconvenience when inadequate space is available for accommodating the bags.

SUMMARY OF THE INVENTION

It is an object of the invention to provide a new and useful golf club bag which may be folded or configured to fit in a variety of spaces, and yet is rugged and sturdy.

It is another object of the invention to provide such a golf club bag which is easy and inexpensive to construct.

It is a further object of the invention to provide a golf club bag which may be configured to have either a generally flat profile or a generally "bundled" profile.

It is an additional object of the invention to provide such a golf club bag which may be readily changed from one configuration to the other.

The above and other objects of the invention are realized in a specific illustrative embodiment of a golf bag which includes an array of generally elongate receptacles flexibly joined together in a row. Each receptacle is dimensioned so that it may receive the handle of a golf club and each is generally parallel with the other receptacles. Also included is a handle coupled to the receptacles to allow for carrying the bag. The receptacles are flexibly joined so that they may be folded, rolled up, laid generally flat, or placed in a variety of different configurations depending upon the space into which they are fitted. Fastening elements are located on the endmost receptacles for joining the endmost receptacles together to form the array generally into a circle.

In accordance with one aspect of the invention, a second array of generally elongate receptacles are flexibly joined together and are attached to the first array, centrally thereof. When the first array is folded into a circle, they generally circumscribe the second array, which is fewer in number.

In accordance with another aspect of the invention, a golf ball enclosure is positioned centrally of the second array of receptacles so that when the first array is folded into a circle, the golf ball enclosure and the second array of receptacles are generally circumscribed by the first array.

Advantageously, a flexible cover is provided for fitting over the top of the bag when the receptacles are folded into a circle.

The above-described configuration offers considerable flexibility in storing and transporting the golf bag since it can be folded, laid flat, or oriented in a variety of other positions to fit into available storage or carrying space.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
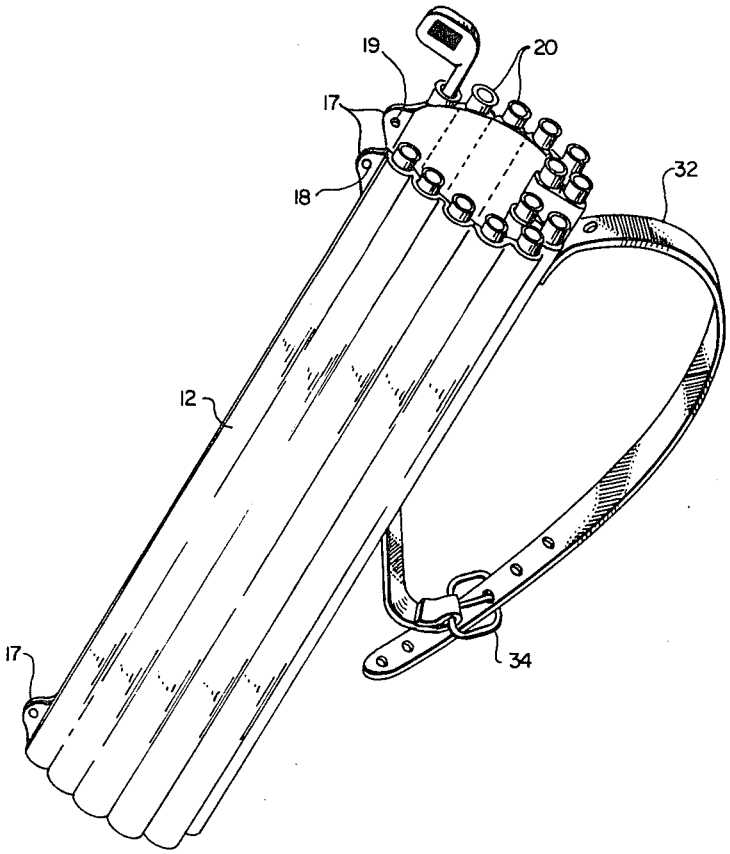
FIG. 1 is a perspective view of a golf club bag made in accordance with the principles of the present invention.

Referring to the drawings, there is shown a golf club bag generally indicated by the numeral 4. The bag includes a first piece of generally planar flexible material 8 (best seen in FIG. 3) joined to a second piece of flexible material 12 which is formed with generally elongate folds as shown. The first and second pieces of material 8 and 12 are joined together by stitching 16 or other suitable attachment mechanism, with the stitching extending lengthwise on either side of a fold.

Advantageously, inserted within each fold is a hollow, cylindrical tube 20 made of plastic or other suitable material similar to those presently used for holding golf clubs in conventional golf club bags. The tubes 20 extend substantially the full length of the receptacles and maintain openings into which golf club handles may be inserted. The interior dimensions of the tubes 20, of course, are such that a conventional golf club handle may be inserted thereinto. The tubes 20 need not be used if a person preferred to simply insert the golf clubs directly into the openings formed by the folds.

Figure 2:
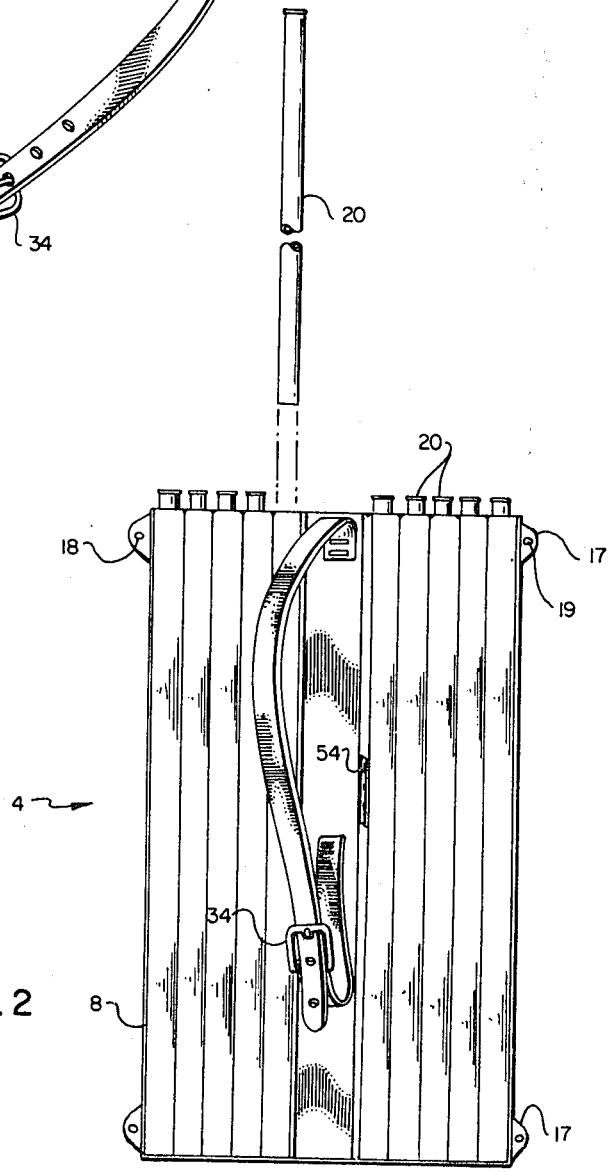
FIG. 2 is a back, elevational view of the golf club bag of FIG. 1 showing one of the plastic golf club holding tubes removed and fragmented.
Figure 3:
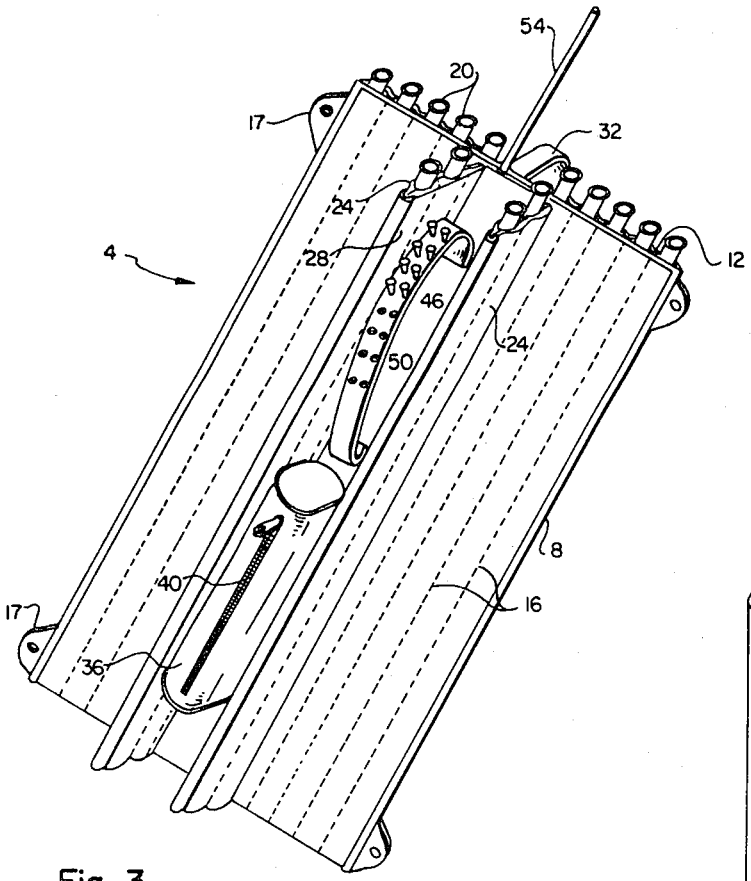
FIG. 3 shows a generally front, perspective view of the golf club bag of FIG. 1 where the primary golf club holding receptacles are arranged in a substantially linear row.
Figure 4:
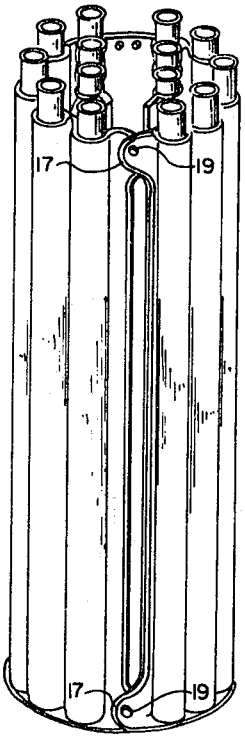
FIG. 4 is another generally front, perspective view of the golf club bag shown in the folded or bundled configuration.

The material 8 and 12 may be made of heavy cloth, synthetic material or other suitable flexible material to allow folding or configuring the receptacles in either a "bundled" position as in FIG. 4 or a generally flat position as in FIGS. 2 and 3. This facilitates placement of the receptacles in a variety of storage or carrying spaces.

Tabs 17 extend laterally of the endmost folds near the top and bottom thereof. The tabs are positioned so that when the receptacles are folded or "bundled", the two topmost tabs overlap and the two bottommost tabs overlap as shown in FIG. 4. In each pair of overlapping tabs, a male snap element 18 and female snap element 19 are installed on different respective tabs to enable fastening the tabs together as indicated in FIG. 4. In this manner, the receptacles may be secured in the folded configuration. Of course, other fastening elements, such as VELCRO, hooks and eyes, etc., could also be used in place of the snaps.

A second array of receptacles is formed of two pieces of material 24 and 28, being joined together by stitching or other suitable attachment mechanisms in a manner similar to that described for the first array. The second array is attached back-to-back to the first array as best seen in FIG. 3. The first array is shown as having a total of 10 receptacles, whereas the second array has only four. Advantageously a hollow, cylindrical plastic tube is inserted in each one of the receptacles of the second array, again for maintaining the opening into which a golf club handle could be inserted.

Located centrally of the first array of receptacles is a strap 32, one end of which is attached to the material 12 near the top thereof and the other end of which is attached to the material 12 about midway between the top and bottom to form a loop as shown. An equal number of receptacles are positioned on each side of the strap 32. The strap 32 serves as a handle for carrying the golf bag in the conventional manner. The strap 32 includes a conventional buckle 34 to enable shortening or lengthening the loop formed by the strap. The strap 32 may be constructed of any suitably sturdy and long-lasting material such as leather, imitation leather, sturdy cloth, etc.

Disposed centrally of the second array of receptacles is a pouch or enclosure 36 into which golf balls, golf tees, and other playing equipment may be placed. An opening is formed in the front of the enclosure with a zipper 40 attached thereto for allowing closure of the opening. The enclosure 36 is generally elongate so that it fits neatly between two of the receptacles on one side and two on the other side of the second array. The enclosure 36 is attached to material 28 which is used to partly form the second array of receptacles.

A golf tee-holding strap 44 is attached also to the material 28 above the enclosure 36 to carry tees 46 at a readily accessible location. Openings 50 are formed in the strap 44 so that the pointed ends of the tees may be inserted thereinto as shown.

Stiffening rods 54 are disposed on each side of the strap 32 (and enclosure 36 and tee-holding strap 44) between material 8 and 12. These rods extend substantially the full length of the bag to make it more rigid in the long direction. Of course, the rods 54 could be placed in the bag in a variety of locations to provide the desired rigidity. Advantageously, the rods are made of steel.

With the golf bag structure described, a bag may be oriented to be generally flat or it may be folded to be generally "bundled".

Figure 5:
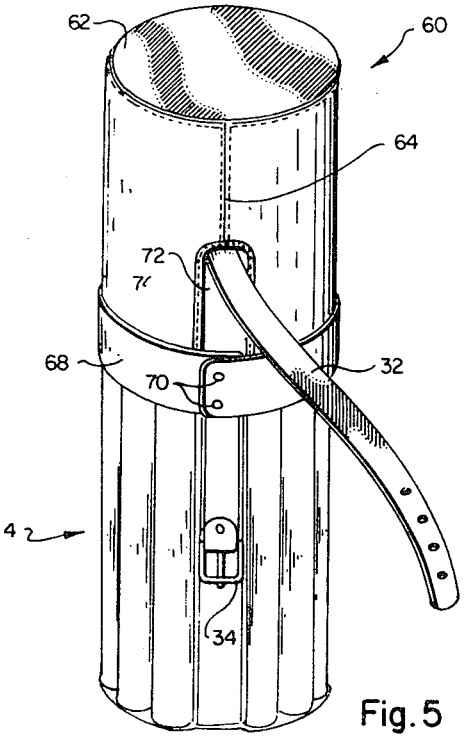
FIG. 5 is a perspective view of the golf club bag showing a cover in place on the bag.

FIG. 5 shows the golf bag in the folded configuration with a cover 60 placed over the top of the bag. The cover is generally cylindrical in shape and made of a flexible material such as cloth, canvas, leather, imitation leather, etc. The cover includes a top piece of material 62 and a side wall piece of material 64 which is joined at its top edge to the perimeter of the top piece 62 and which is formed into a cylinder with its lateral edges joined in a seam 66. A Strip of material 68 is joined at its upper edge to the bottom edge of the material 64 to wrap around the bag so that the ends of the material 68 overlap. Snaps 70 or other fastening elements 70 are installed in the ends of the material 68 so that the ends may be joined together as shown. An opening 72 is formed in the side wall material 64 just above the strip of material 68 to allow the strap 32 to extend therethrough to reach the buckle 34. When the strap 32 is bucked to the buckle 34 over the strip of material 68, the strap prevents removal of the cover. It should be understood that the cover 60 could be constructed in a variety of ways, with the principal features being that it fit over the top of the bag 4, that an opening 72 be provided for the strap 32, and that the portion of the cover just under the opening 72 be joinable and unjoinable by provision of fasteners of some type.

It is to be understood that the specific embodiment discussed above is only illustrative of the principles of the present invention and that numerous other embodiments and configurations could be made by those skilled in the art without departing from the spirit and scope of the invention. For example, any number of receptacles may be added to or substracted from the two arrays shown. Likewise, only one array need by provided, depending upon the desires of the user. Additionally, the receptacles for receiving the golf club handles could be formed in a variety of ways besides that shown in the drawings and described above.

What is claimed is:

1. A golf bag including:

a plurality of generally elongate receptacles, each of a dimension sufficient to receive the handle of a golf club, means joining the receptacles together in a generally parallel arrangement and generally in a row, said joining means being flexible, handle means coupled to said receptacles or joining means to enable holding the receptacles, fastening means disposed on each of the two endmost receptacles in the row for fastening the two receptacles together to secure the receptacles in a folded configuration, an additional plurality of generally elongate receptacles, each of a dimension sufficient to receive the handle of a golf club, means joining the additional receptacles together in a generally parallel arrangement and generally in a row, and means connecting the additional receptacles to the first-mentioned receptacles in a generally back-to-back relationship.

2. A golf bag as in claim 1 wherein the first-mentioned receptacles are formed from two pieces of flexible material, a first of which is generally planar and a second of which is formed with generally elongate folds and joined to the first material on each side of a fold.

3. A golf bag as in claim 2 further including a plurality of hollow, elongate and generally rigid conduits, each insertable within a fold formed by the second material and each dimensioned to receive the handle of a golf club.

4. A golf bag as in claim 1 wherein said handle means is disposed centrally of said first-mentioned receptacles so that an equal number of receptacles are positioned on each side of the handle means.

5. A golf bag as in claim 4 wherein said handle means is disposed on one side of said first-mentioned receptacles, and wherein said additional receptacles are connected to said first-mentioned receptacles on the other side thereof.

6. A golf bag as in claim 1 wherein said handle means comprises a strap joined at one end to the bag near the top thereof, and joined at the other end to the bag about midway between the top and bottom thereof.

7. A golf bag as in claim 6 further including a cover for placement over the top of the bag when the receptacles are in the folded configuration, said cover including a top portion of material, a side wall portion of material formed generally into a cylinder and joined at its upper edges to the edges of the top portion, and an opening in one side of the side wall portion of material through which the strap may extend.

8. A golf bag as in claim 7 wherein that portion of the side wall of the cover below the opening is disconnected, and wherein the cover further includes fastening means for selectively joining together and unjoining those portions of the cover below the opening.

9. A golf bag as in claim 1 further including elongate stiffening elements disposed in the joining means to extend generally parallel with the receptacles.

* * * * *